US010431933B2

(12) United States Patent
Gibeau

(10) Patent No.: US 10,431,933 B2
(45) Date of Patent: Oct. 1, 2019

(54) HIGH VOLTAGE CONNECTOR ASSEMBLY

(71) Applicant: Ford Global Technologies, LLC, Dearborn, MI (US)

(72) Inventor: John Paul Gibeau, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 15/182,019

(22) Filed: Jun. 14, 2016

(65) Prior Publication Data

US 2016/0294119 A1 Oct. 6, 2016

Related U.S. Application Data

(63) Continuation of application No. 14/265,441, filed on Apr. 30, 2014.

(51) Int. Cl.
*H01R 13/641* (2006.01)
*H01R 13/46* (2006.01)
(Continued)

(52) U.S. Cl.
CPC ..... *H01R 13/641* (2013.01); *H01R 13/465* (2013.01); *H01R 24/20* (2013.01);
(Continued)

(58) Field of Classification Search
CPC ..... H01R 13/641; H01R 13/465; H01R 13/62955; H01R 13/62938; H01R 13/62933
(Continued)

(56) References Cited

U.S. PATENT DOCUMENTS 4,902,244 A * 2/1990 Endo ..... H01R 13/465 235/462.01
4,997,376 A * 3/1991 Buck ..... H01R 13/04 439/59
(Continued)

FOREIGN PATENT DOCUMENTS

CN 203481067 U 3/2014
JP 2006351275 A 12/2006

OTHER PUBLICATIONS

The State Intellectual Property Office of P.R. China, The First Office Action of the corresponding Chinese Patent Application No. 201510213956.4 dated May 29, 2018.

*Primary Examiner* — Tulsidas C Patel
*Assistant Examiner* — Marcus E Harcum
(74) *Attorney, Agent, or Firm* — David Kelley; Brooks Kushman, P.C.

(57) ABSTRACT

A high voltage connector assembly includes a first connector and a second connector. The first connector has two tiers of pins and a first portion of an identification mark. The second connector includes a second portion of the mark and has two tiers of wells sized to engage the pins without other mechanical fasteners. The first and second portions are arranged on the connectors such that the portions are aligned to define the mark when the connectors are completely engaged. The mark may include one or more electronically readable indicators identifying each of the first and second connectors. The connectors may electrically connect a first vehicle component in communication with the pins and a second vehicle component in communication with the wells when the connectors are completely engaged.

16 Claims, 5 Drawing Sheets

(51) Int. Cl.
*H01R 24/20* (2011.01)
*H01R 24/28* (2011.01)
*H01R 107/00* (2006.01)

(52) U.S. Cl.
CPC ..... *H01R 24/28* (2013.01); *H01R 2107/00* (2013.01); *H01R 2201/26* (2013.01)

(58) Field of Classification Search
USPC ..... 439/491, 489, 352, 141, 142, 660, 372
See application file for complete search history.

(56) References Cited

U.S. PATENT DOCUMENTS 5,169,336 A 12/1992 Taguchi
5,330,372 A * 7/1994 Pope ..... H01R 13/26 439/682
5,556,287 A 9/1996 Kuhn et al.
5,588,873 A 12/1996 Hamai et al.
5,641,310 A * 6/1997 Tiberio, Jr. ..... H01R 13/625 439/680
6,746,271 B2 * 6/2004 Simmel ..... H01R 13/465 439/491
6,817,891 B2 * 11/2004 Wrede ..... G09F 3/00 439/491
6,976,885 B2 12/2005 Lord
7,044,769 B2 5/2006 Zhao et al.
7,374,460 B1 * 5/2008 Hariharesan ..... H01R 13/187 439/679
7,568,933 B2 8/2009 Shirai et al.
8,834,187 B2 * 9/2014 Furuya ..... H01R 13/62933 439/153
8,986,024 B2 3/2015 Ikeda et al.
9,130,324 B2 * 9/2015 Furuya ..... H01R 24/005
9,583,860 B1 * 2/2017 DeWitte ..... H01R 13/436
2003/0040213 A1 2/2003 Norwood et al.
2005/0098419 A1 * 5/2005 Matsui ..... H01R 13/62933 200/311
2005/0208820 A1 * 9/2005 Sanuki ..... H01R 13/623 439/372
2008/0166913 A1 7/2008 Siebens et al.
2008/0311779 A1 12/2008 Brassell et al.
2009/0104806 A1 4/2009 Pellen
2009/0263997 A1 10/2009 Tonosaki
2012/0077369 A1 * 3/2012 Andersen ..... H01R 13/642 439/488
2014/0065857 A1 * 3/2014 Guillanton ..... H01R 13/5202 439/131
2014/0127926 A1 * 5/2014 Condo ..... H01R 13/6456 439/345
2015/0263668 A1 * 9/2015 Sader ..... H02S 40/30 439/395
2015/0349472 A1 * 12/2015 Zebhauser ..... H01R 13/6463 439/660
2017/0229813 A1 * 8/2017 Exenberger ..... H01R 13/6295
2018/0102609 A1 * 4/2018 Yang ..... H01R 13/631

* cited by examiner

HIGH VOLTAGE CONNECTOR ASSEMBLY

CROSS-REFERENCE TO RELATED APPLICATION

This application is a continuation of application Ser. No. 14/265,441, filed Apr. 30, 2014, now U.S. Pat. No. 9,748,695, the disclosure of which is hereby incorporated in its entirety by reference herein.

TECHNICAL FIELD

This disclosure relates to electrical connectors for high voltage battery systems utilized in vehicles.

BACKGROUND

Vehicles such as battery-electric vehicles (BEVs), plug-in hybrid-electric vehicles (PHEVs), mild hybrid-electric vehicles (MHEVs), or full hybrid-electric vehicles (FHEVs) contain a traction battery, such as a high voltage (HV) battery, to act as a propulsion source for the vehicle. The HV battery may include components and systems to assist in managing vehicle performance and operations. The HV battery may include one or more arrays of battery cells interconnected electrically between battery cell terminals and interconnector busbars. The HV battery and surrounding environment may include a thermal management system to assist in managing temperature of the HV battery components, systems, and individual battery cells.

SUMMARY

A high voltage connector assembly includes a first connector and a second connector. The first connector has two tiers of pins and a first portion of an identification mark. The second connector includes a second portion of the mark and has two tiers of wells sized to engage the pins without other mechanical fasteners. The first and second portions are arranged on the connectors such that the portions are aligned to define the mark when the connectors are completely engaged. The mark may include one or more electronically readable indicators identifying each of the first and second connectors. The connectors may electrically connect a first vehicle component in communication with the pins and a second vehicle component in communication with the wells when the connectors are completely engaged. The mark may be electronically readable when the connectors are completely engaged and not electronically readable otherwise. The mark may include indicia indicative of adapter engagement or adapter mis-engagement.

A high voltage connector assembly includes a first connector and a second connector. The first connector includes a male adapter and an identification mark. The second connector includes a supplemental mark having a portion of the identification mark and a female adapter to mate with the first connector and defines an alignment window. The marks and window are arranged with one another such that the portion of the identification mark covers part of the identification mark to define a complete rendering of the identification mark readable through the window by an external device only when the connectors are fully mated to one another. The mark may include one or more electronically readable indicators identifying each of the first and second connectors. The indicators may be electronically readable by an external device. The first connector may include a feature configured to prevent access to the identification mark if the connectors are not fully mated to one another.

DETAILED DESCRIPTION

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the present invention. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
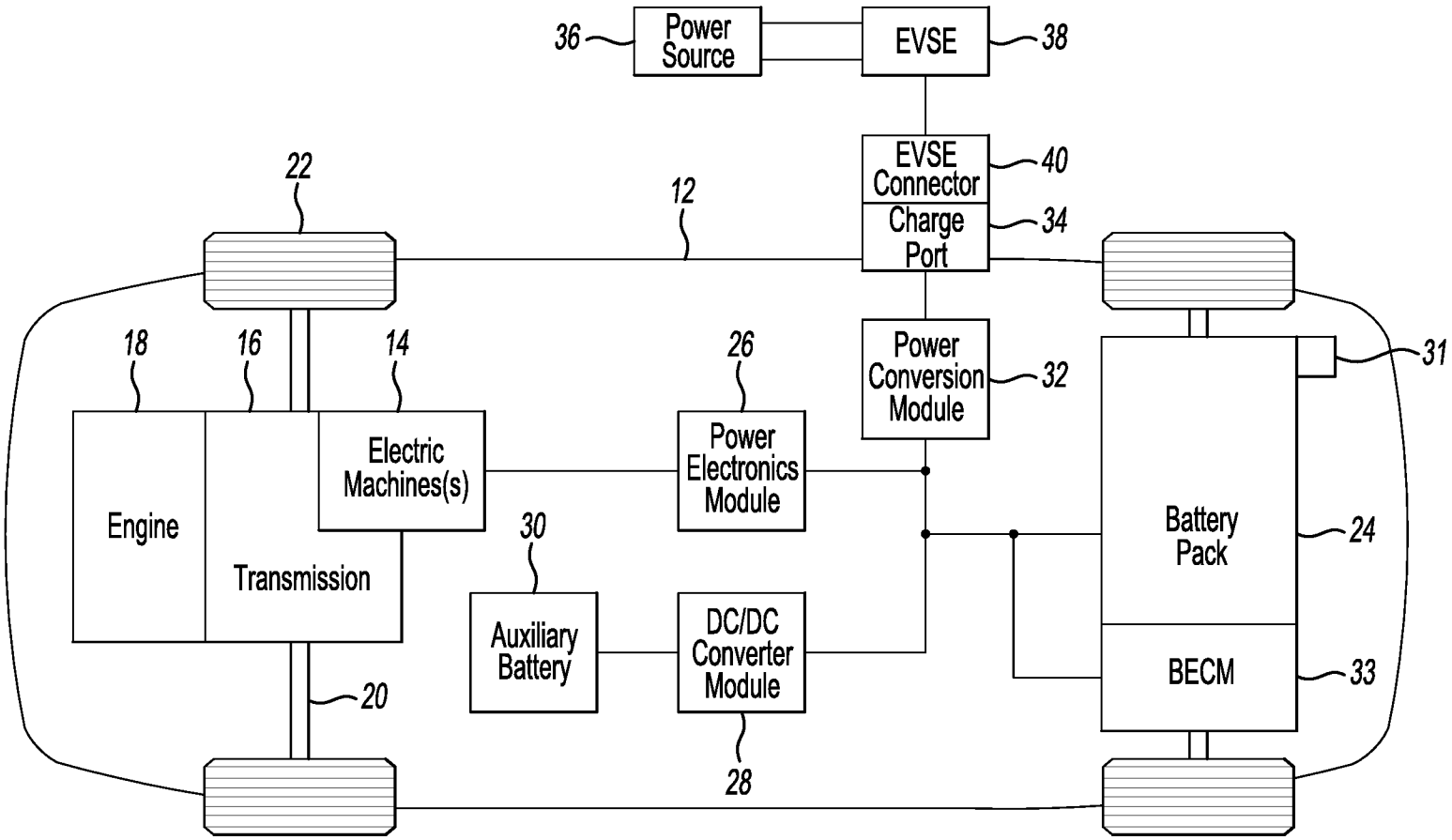
FIG. 1 is a schematic illustration of a plug-in hybrid vehicle.
Figure 2A:
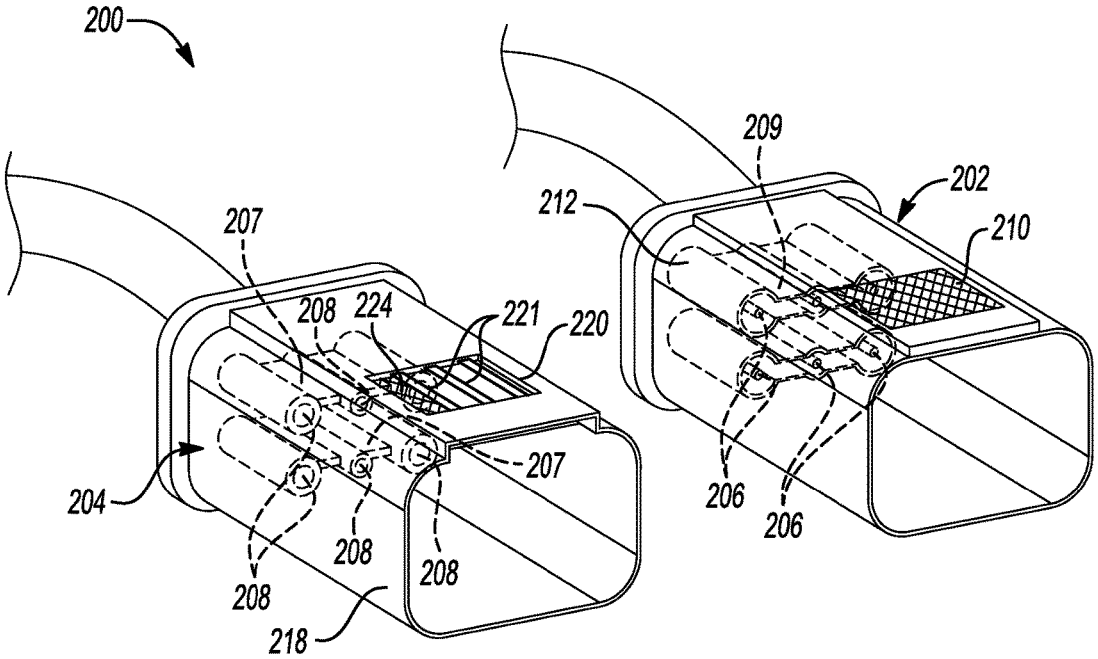
FIG. 2A a perspective view of a high voltage connector assembly showing a first and second connector disengaged.
Figure 2B:
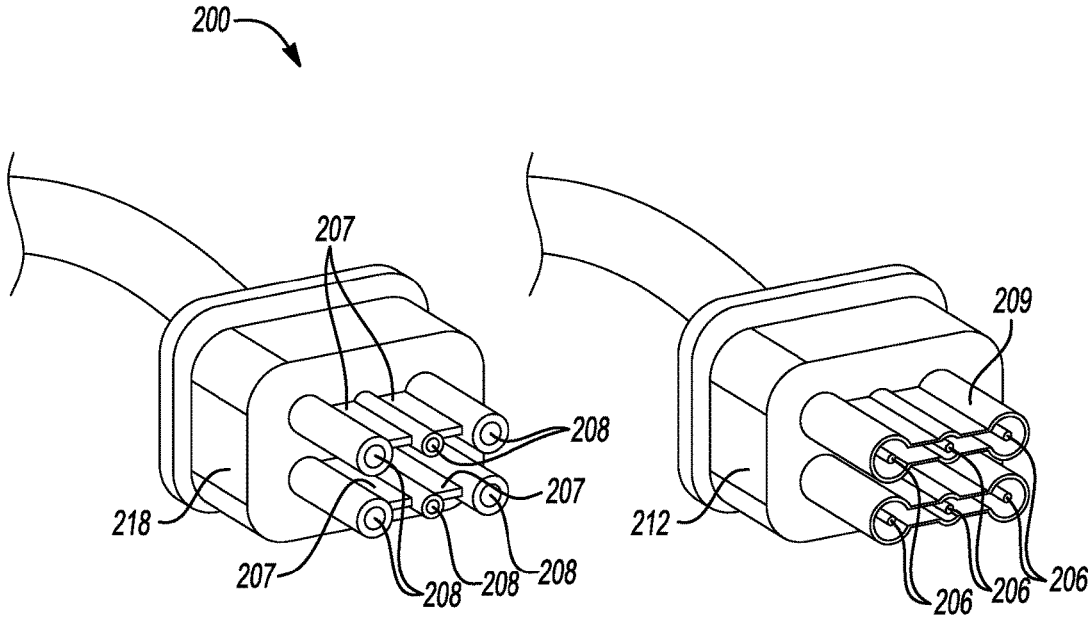
FIG. 2B is a perspective view of the high voltage connector assembly of FIG. 2A with components removed to illustrate details of pins, ribs, and receptacles.
Figure 3:
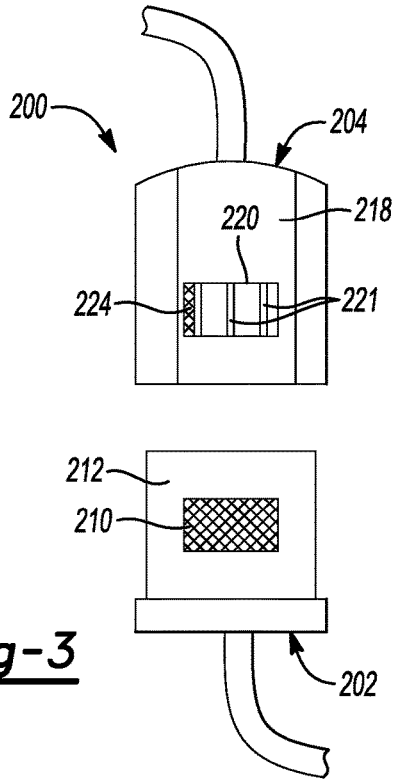
FIG. 3 is a plan view of the high voltage connector assembly of FIG. 2.

FIG. 1 depicts a schematic of a typical plug-in hybrid-electric vehicle (PHEV). A typical plug-in hybrid-electric vehicle 12 may comprise one or more electric machines 14 mechanically connected to a hybrid transmission 16. The electric machines 14 may be capable of operating as a motor or a generator. In addition, the hybrid transmission 16 is mechanically connected to an engine 18. The hybrid transmission 16 is also mechanically connected to a drive shaft 20 that is mechanically connected to the wheels 22. The electric machines 14 can provide propulsion and deceleration capability when the engine 18 is turned on or off. The electric machines 14 also act as generators and can provide fuel economy benefits by recovering energy that would normally be lost as heat in the friction braking system. The electric machines 14 may also provide reduced pollutant emissions since the hybrid-electric vehicle 12 may be operated in electric mode or hybrid mode under certain conditions to reduce overall fuel consumption of the vehicle 12.

A traction battery or battery pack 24 stores and provides energy that can be used by the electric machines 14. The traction battery 24 typically provides a high voltage DC output from one or more battery cell arrays, sometimes referred to as battery cell stacks, within the traction battery 24. The battery cell arrays may include one or more battery cells. The traction battery 24 is electrically connected to one or more power electronics modules 26 through one or more contactors (not shown). The one or more contactors isolate the traction battery 24 from other components when opened and connect the traction battery 24 to other components when closed. The power electronics module 26 is also electrically connected to the electric machines 14 and provides the ability to bi-directionally transfer electrical energy between the traction battery 24 and the electric machines 14. For example, a typical traction battery 24 may provide a DC voltage while the electric machines 14 may require a three-phase AC voltage to function. The power electronics module 26 may convert the DC voltage to a three-phase AC voltage as required by the electric machines 14. In a regenerative mode, the power electronics module 26 may convert the three-phase AC voltage from the electric machines 14 acting as generators to the DC voltage required by the traction battery 24. The description herein is equally applicable to a pure electric vehicle. For a pure electric vehicle, the hybrid transmission 16 may be a gear box connected to an electric machine 14 and the engine 18 may not be present.

In addition to providing energy for propulsion, the traction battery 24 may provide energy for other vehicle electrical systems. A typical system may include a DC/DC converter module 28 that converts the high voltage DC output of the traction battery 24 to a low voltage DC supply that is compatible with other vehicle loads. Other high-voltage loads, such as compressors and electric heaters, may be connected directly to the high-voltage without the use of a DC/DC converter module 28. In a typical vehicle, the low-voltage systems are electrically connected to an auxiliary battery 30 (e.g., 12V battery).

A battery energy control module (BECM) 33 may be in communication with the traction battery 24. The BECM 33 may act as a controller for the traction battery 24 and may also include an electronic monitoring system that manages temperature and charge state of each of the battery cells. The traction battery 24 may have a temperature sensor 31 such as a thermistor or other temperature gauge. The temperature sensor 31 may be in communication with the BECM 33 to provide temperature data regarding the traction battery 24. The temperature sensor 31 may also be located on or near the battery cells within the traction battery 24. It is also contemplated that more than one temperature sensor 31 may be used to monitor temperature of the battery cells.

The vehicle 12 may be, for example, an electric vehicle such as a PHEV, a FHEV, a MHEV, or a BEV in which the traction battery 24 may be recharged by an external power source 36. The external power source 36 may be a connection to an electrical outlet. The external power source 36 may be electrically connected to electric vehicle supply equipment (EVSE) 38. The EVSE 38 may provide circuitry and controls to regulate and manage the transfer of electrical energy between the power source 36 and the vehicle 12. The external power source 36 may provide DC or AC electric power to the EVSE 38. The EVSE 38 may have a charge connector 40 for plugging into a charge port 34 of the vehicle 12. The charge port 34 may be any type of port configured to transfer power from the EVSE 38 to the vehicle 12. The charge port 34 may be electrically connected to a charger or on-board power conversion module 32. The power conversion module 32 may condition the power supplied from the EVSE 38 to provide the proper voltage and current levels to the traction battery 24. The power conversion module 32 may interface with the EVSE 38 to coordinate the delivery of power to the vehicle 12. The EVSE connector 40 may have pins that mate with corresponding recesses of the charge port 34.

The various components discussed may have one or more associated controllers to control and monitor the operation of the components. The controllers may communicate via a serial bus (e.g., Controller Area Network (CAN)) or via discrete conductors.

The battery cells, such as a prismatic cell, may include electrochemical cells that convert stored chemical energy to electrical energy. Prismatic cells may include a housing, a positive electrode (cathode) and a negative electrode (anode). An electrolyte may allow ions to move between the anode and cathode during discharge, and then return during recharge. Terminals may allow current to flow out of the cell for use by the vehicle. When positioned in an array with multiple battery cells, the terminals of each battery cell may be aligned with opposing terminals (positive and negative) adjacent to one another and a busbar may assist in facilitating a series connection between the multiple battery cells. The battery cells may also be arranged in parallel such that similar terminals (positive and positive or negative and negative) are adjacent to one another. For example, two battery cells may be arranged with positive terminals adjacent to one another, and the next two cells may be arranged with negative terminals adjacent to one another. In this example, the busbar may contact terminals of all four cells.

Various battery pack configurations may be available to address individual vehicle variables including packaging constraints and power requirements. HV connectors may be used to connect different components within the different battery pack configurations and the components proximate thereto. Various operating requirements and conditions may be considered when determining a suitable type of HV connector for a particular circumstance. For example, an operating voltage, an environment of the connector, and assembly/installation considerations may be examined to assist in designing a male and female portion for the particular HV connector. When assembling electrical circuits within vehicles, incomplete connections of HV connectors, wire harnesses, or other similar connectors may sometimes result. These incomplete connections may occur due to operator error. The operator may not be able to determine whether the connector is fully seated. While it may be possible to utilize certain test methods to examine the connection, the time associated with such testing may not be acceptable in an assembly and/or installation environment. Additionally, while the electrical circuit between the mating connectors may be complete and thus pass a traditional connectivity test, the connectors may not be fully seated, engaged, or mated from a structural standpoint and as such, could eventually separate during vehicle operating conditions to create a failure or fault condition. Further, in an assembly setting it may be desirable to not only track parts and components throughout the installation processes, but also to track whether certain connectors fully mate and to provide a signal to operators indicating the same.

FIGS. 2A through 4 show an example of a HV connector assembly. A HV connector assembly 200 may include a male connector 202 and a female connector 204. The male connector 202 may include one or more pins 206. The female connector 204 may include one or more receiving wells 208 and one or more ribs 207 extending between pairs of receiving wells 208. A female receptacle (not shown) may be included within the receiving wells 208. The receiving wells 208 may be configured to receive the corresponding pins 206 and to assist in completing an electrical circuit between the pins 206 and the female receptacle. The male connector 202 may further include a housing 209 sized to receive the one or more ribs 207 and to orient connection of the pins 206 and the receiving wells 208. FIG. 2B is a perspective view of the male connector 202 and the female connector 204 shown with components removed to further illustrate the one or more pins 206, the one or more ribs 207, the one or more receiving wells 208, and the housing 209. In this example, the HV connector assembly 200 may be utilized to form an inline circuit connecting two separate wire harnesses from two vehicle components such as a charge port and a power conversion module. For example, an inline connection may be used to connect the charge port 34 with the power conversion module 32 of FIG. 1.

The male connector 202 may include an identification mark 210 secured to or defined by a housing 212 of the male connector 202. The mark 210 may include one or more digitally identifiable items which may be read by an external device (not shown). For example, the mark 210 may include information relating to the male connector 202 such as a part number or instructions for the external device. The mark 210 may be in the form of an identification signature, a quick response code (QR code), or a bar code. Other forms for the mark 210 are available which may include digitally identifiable items. The external device may be a scanning device and include a sensor to capture and/or read the mark 210. In one example, the external device may scan the mark 210 and access one or more sets of instructions included within the mark 210. A set of instructions may direct the external device to trigger a signal, such as an audio or visual signal, indicating that the male connector 202 is engaged, seated or mated with the female connector 204. Another set of instructions may direct the external device to trigger a signal indicating that the male connector 202 and the female connector 204 are not seated or mated with one another. Yet another set of instructions may direct the external device to trigger a signal to be sent to a server indicating the male connector 202 and the female connector 204 are engaged or whether a fault condition is present. It is contemplated that other examples of the external device which utilize a sensor may be available to read the mark 210.

Figure 4:
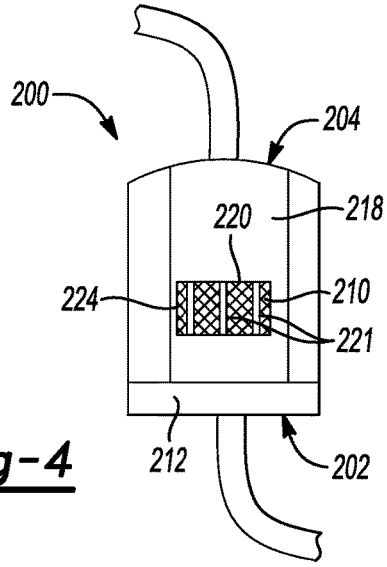
FIG. 4 is a plan view of the high voltage connector assembly of FIG. 2 showing the first and second connector engaged.

The female connector 204 may be configured to mate with the male connector 202 and include a housing 218 which may define an alignment window 220. The alignment window 220 may be sized according to the identification mark 210 of the male connector 202 and may optionally include one or more blockers 221. For example, the alignment window 220 may be such that the identification mark 210 is readable by the external device only when the male connector 202 and the female connector 204 are fully mated. In this example, the identification mark 210 may not be readable unless the blockers 221 are covering a portion of the identification mark 210. Conversely, the housing 218 may include a feature to prevent access to the identification mark 210 when the male connector 202 and the female connector 204 are partially mated. Optionally, the female connector 204 may include a supplemental mark 224 located adjacent to the alignment window 220. In this example, the supplemental mark 224 and the identification mark 210 may include digitally identifiable items which may only be readable by the external device when the supplemental mark 224 and the identification mark 210 are properly aligned. For example, the supplemental mark 224 and the identification mark 210 may together include a set of instructions which may direct the external device to trigger a signal indicating that the male connector 202 and the female connector 204 are fully mated as shown in FIG. 4.

Figure 5:
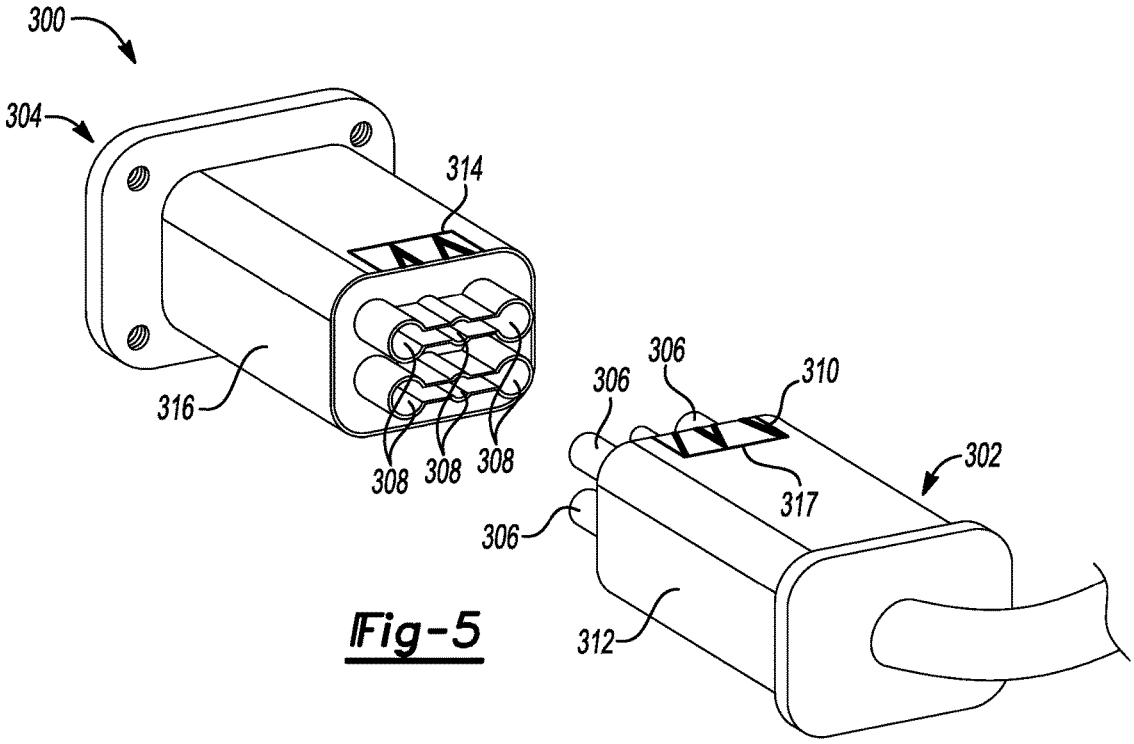
FIG. 5 is a perspective view of another high voltage connector assembly showing a first and second connector disengaged.
Figure 6:
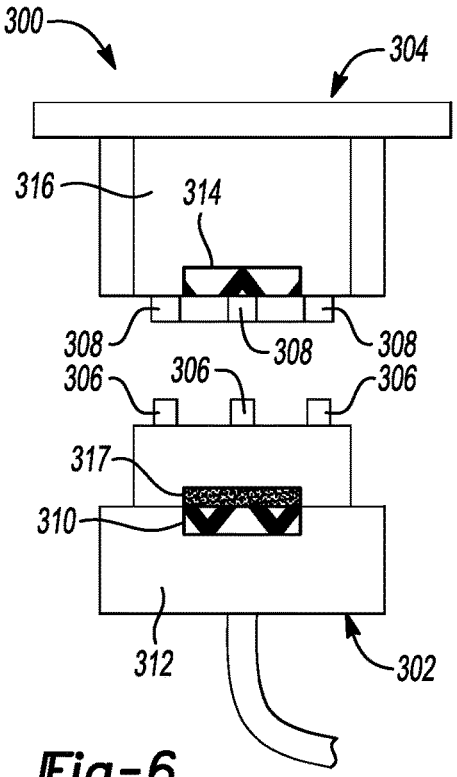
FIG. 6 is a plan view of the high voltage connector assembly of FIG. 5.
Figure 7:
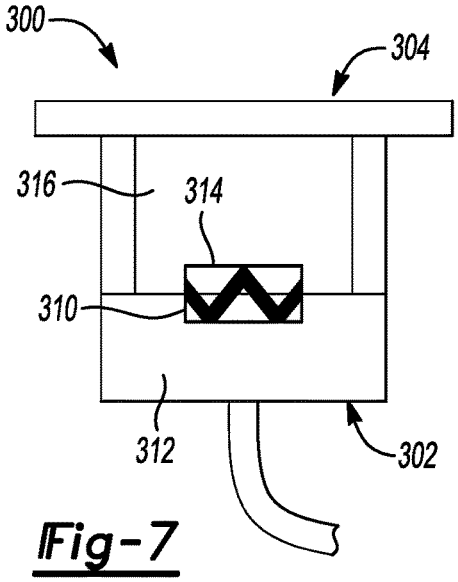
FIG. 7 is a plan view of the high voltage connector assembly of FIG. 5 showing the first and second connector engaged.

FIGS. 5 through 7 show another example of a HV connector assembly. A HV connector assembly 300 may include a male connector 302 and a female connector 304. The male connector 302 may include an adapter such as one or more pins 306. The female connector 304 may include one or more receiving wells 308. A female adapter, such as a female receptacle (not shown) may be included within the receiving wells 308. The receiving wells 308 may be configured to receive the corresponding pins 306 and to assist in completing an electrical circuit between the pins 306 and the female receptacle. In this example, the connector assembly 300 may be located at a battery pack to facilitate an electrical connection to a high voltage harness leading to a power conversion module, such as the battery pack 24 and power conversion module 32 of FIG. 1.

The male connector 302 may include a first portion 310 of an identification mark secured to or defined by a housing 312 of the male connector 302. The female connector 304 may be configured to mate with the male connector 302. The female connector 304 may include a second portion 314 of the identification mark secured to or defined by a housing 316 of the female connector 304. The first portion 310 and the second portion 314 may together form the identification mark in this example when the male connector 302 and the female connector 304 are fully mated. The first portion 310 and the second portion 314 may include one or more digitally identifiable items which may be read by an external device (not shown).

For example, the mark may include information relating to the male connector 302 and/or the female connector 304 such as a part number or instructions for the external device. The mark may be in the form of an identification signature, a QR code, or a bar code. Other forms for the mark are available which may include digitally identifiable items. The external device may be a scanning device and include a sensor to capture and/or read the first portion 310 and the second portion 314. In one example, the external device may scan the first portion 310 and the second portion 314 and access one or more sets of instructions included therein. A set of instructions may direct the external device to trigger a signal, such as an audio or visual signal, indicating that the male connector 302 is engaged or mated with the female connector 304. Another set of instructions may direct the external device to trigger a signal indicating that the male connector 302 and the female connector 304 are not mated to one another. Yet another set of instructions may direct the external device to trigger a signal to be sent to a server indicating the male connector 302 and the female connector 304 are engaged or whether a fault condition is present. Optionally, a label 317 may be secured to the housing 312 adjacent to the first portion 310. The label may be visible only when the first portion 310 and second portion 314 are not fully mated. The label 317 may include an identifier, such as a color, which when read by the external device triggers a signal indicating a fault condition. Other examples of identifiers may be available.

A manual service disconnect is another example of an HV connector utilized in battery electric vehicles. Manual service disconnects may include a mechanical switch configured to disconnect the high voltage in an electrical bus of a HV battery when removed. An interlock switch may be disconnected during the process of removing the service disconnect switch to break the high voltage in the electrical bus. Optionally, an access cover may house two HV battery cable connection points at a battery bus electric center module. The cover may include features to prevent removal of the cover prior to removal of the service disconnect switch. A combination of the service disconnect switch and the cover may assist in preventing exposure to the high voltage during operation.

Figure 8A:
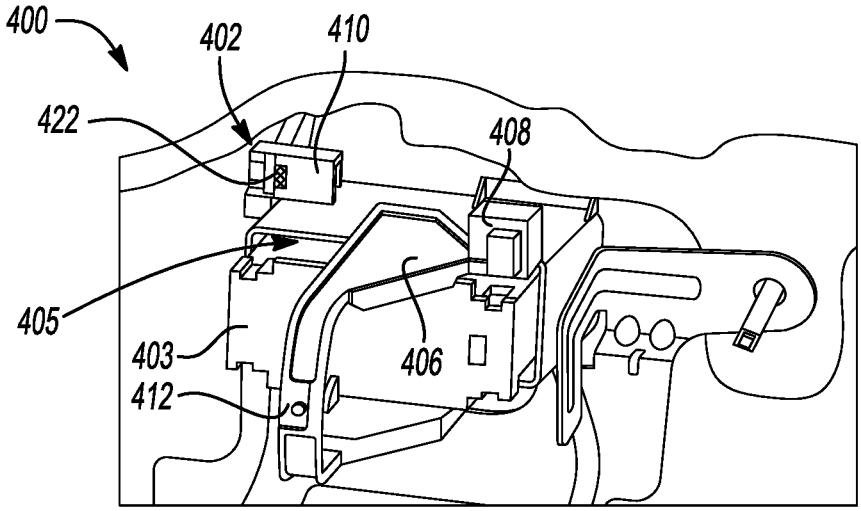
FIG. 8A is a perspective view of a manual service disconnect shown in a first position prior to engagement with a portion of a traction battery.
Figure 8B:
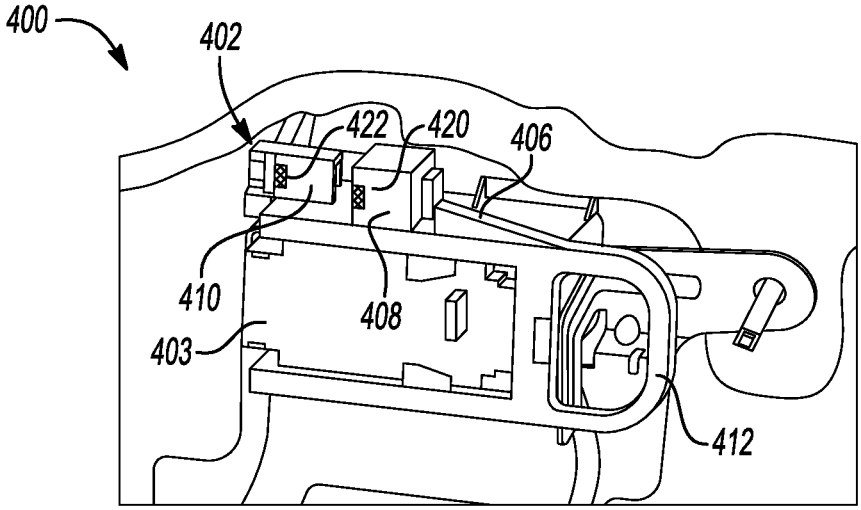
FIG. 8B is a perspective view of the manual service disconnect from FIG. 8A shown in a second position prior to engagement with the portion of the traction battery.
Figure 8C:
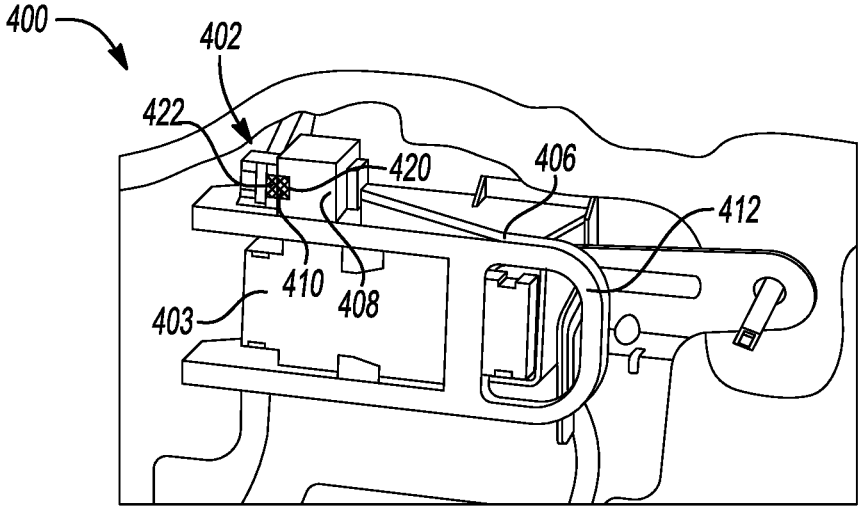
FIG. 8C is a perspective view of the manual service disconnect from FIG. 8A shown in a third position engaged to the portion of the traction battery.

FIGS. 8A through 8C show another HV connector assembly 400 which may include a service disconnect 402. The service disconnect 402 may include a body 403, an electrical connector (not shown), and a pivotal member 406. The pivotal member 406 may include an interlock switch 408 which may engage with an interlock 410. When installed in the connector assembly 400, the interlock switch 408 and the electrical connector complete an electrical circuit. The pivotable member 406 may be mounted to the body 403 for rotation and translation. The pivotable member 406 may also include a handle 412 to assist in manipulating the pivotable member 406.

The body 403 may include a first portion 420 of an identification mark secured to or defined by the body 403. The pivotable member 406 may include a second portion 422 of the identification mark secured to or defined by the pivotable member 406. The first portion 420 and the second portion 422 may together form the identification mark in this example when the interlock 410 and the interlock switch 408 are fully engaged. The first portion 420 and the second portion 422 may include one or more digitally identifiable items which may be read by an external device (not shown) when properly aligned to form the identification mark.

For example, the identification mark may include information relating to the components of the service disconnect 402 such as part numbers or instructions for the external device. The mark may be in the form of an identification signature, a QR code, or a bar code. Other forms for the mark are available which may include digitally identifiable items. The external device may be a scanning device and include a sensor to capture and/or read the first portion 420 and the second portion 422. In one example, the external device may scan the first portion 420 and the second portion 422 and access one or more sets of instructions included therein. A set of instructions may direct the external device to trigger a signal, such as an audio or visual signal, indicating that the first portion 420 and the second portion 422 are aligned and thus the interlock switch 408 is engaged with the interlock 410. Another set of instructions may direct the external device to trigger a signal indicating that the interlock switch 408 is not engaged with the interlock 410. For example, the first portion 420 and second portion 422 may each include this type of instructions such that a signal indicating a fault condition is triggered unless the first portion 420 and the second portion 422 are properly aligned. Yet another set of instructions may direct the external device to trigger a signal to be sent to a server indicating the interlock switch 408 and the interlock 410 are engaged or whether a fault condition is present.

In FIG. 8A, the pivotable member 406 is shown in a first position in which the pivotable member 406 is oriented substantially perpendicular to the body 403. In this first position, the interlock switch 408 and the interlock 410 are not engaged and the first portion 420 and the second portion 422 are not aligned to form the identification mark. Optionally and as described above, the first portion 420 and the second portion 422 may each separately include instructions to trigger a signal indicating a fault condition when either portion is scanned or read separately. In FIG. 8B, the pivotable member 406 is shown in a second position in which the pivotable member 406 is rotated from the first position and is oriented substantially parallel to the body 403. In this second position, the interlock switch 408 and the interlock 410 are not engaged and the first portion 420 and the second portion 422 are not aligned to form the identification mark. In FIG. 8C, the pivotable member 406 is shown in a third position in which the interlock switch 408 and the interlock 410 are engaged, connecting the interlock switch 408 and the interlock 410 to complete the electrical circuit. In this third position, the first portion 420 and the second portion 422 are aligned such that when scanned as the complete identification mark, the external device may access the instructions included therein which may trigger one or more signals indicating full engagement as described above.

Figure 9:
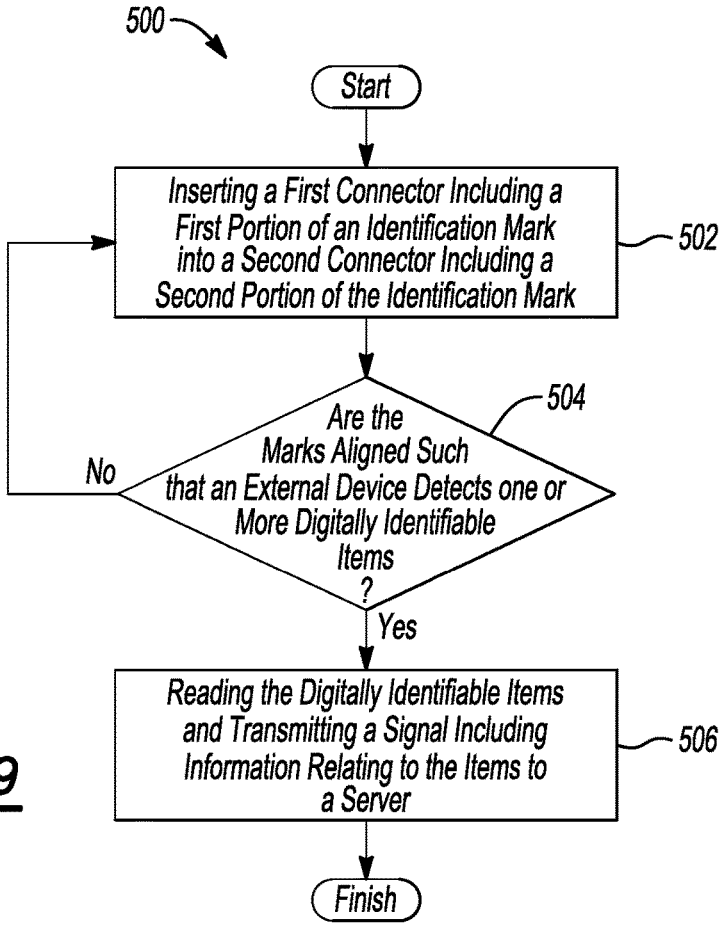
FIG. 9 is a flow chart of an algorithm for testing an engagement state of a high voltage connector assembly.

Now referring to FIG. 9, an algorithm is generally indicated by reference numeral 500. Operation 502 may include inserting a first connector including a first portion of an identification mark into a second connector including a second portion of the identification mark. As described above, the first and second connectors may be HV connectors. The identification mark may include digitally identifiable items. The identification mark may be in the form of an identification signature, a quick response code (QR code), or a bar code. Other forms for the identification mark are available which may include digitally identifiable items. In operation 504, a user may check to determine whether the first portion and second portion of the identification mark are aligned. For example, the user may use an external device, such as a scanner, to scan the first and second portions of the identification mark. If the first portion and second portion of the identification mark are not properly aligned, the user may be directed back to operation 502 to reinsert the first connector to the second connector. If the first portion and second portion of the identification mark are properly aligned, the scanner may read one or more digitally identifiable items included within the identification mark and send a corresponding signal to a server in operation 506. The digitally identifiable items may include, for example, instructions which may direct the external device to trigger a signal to be sent to a server indicating the first connector and the second connector are engaged or whether a fault condition is present.

Optionally, another set of instructions may direct the external device to trigger a signal, such as an audio or visual signal, indicating that the first connector has mated with the second connector. Another set of instructions may direct the external device to trigger a signal indicating that the first connector and the second connector are not mated to one another. Additionally, the one or more digitally identifiable items of the first portion and second portion of the identification mark may only be readable by the external device when the connectors are mated or engaged.

The processes, methods, or algorithms disclosed herein can be deliverable to/implemented by a processing device, controller, or computer, which can include any existing programmable electronic control unit or dedicated electronic control unit. Similarly, the processes, methods, or algorithms can be stored as data and instructions executable by a controller or computer in many forms including, but not limited to, information permanently stored on non-writable storage media such as ROM devices and information alterably stored on writeable storage media such as floppy disks, magnetic tapes, CDs, RAM devices, and other magnetic and optical media. The processes, methods, or algorithms can also be implemented in a software executable object. Alternatively, the processes, methods, or algorithms can be embodied in whole or in part using suitable hardware components, such as Application Specific Integrated Circuits (ASICs), Field-Programmable Gate Arrays (FPGAs), state machines, or other hardware components or devices, or a combination of hardware, software and firmware components.

While various embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and can be desirable for particular applications.

What is claimed is:

1. A high voltage connector assembly comprising:

a first connector having an identification mark;

a second connector including a mark section and arranged to engage the first connector a pivotable member mounted to one of the first connector and second connector and configured to pivot between a first position allowing disengagement of the first and second connector and a second position restricting disengagement of the first and second connector; and an interlock switch arranged to cooperate with the pivotable member and prevent access to at least one of the identification mark and the mark section when the pivotable member is in the first position.

2. The assembly of claim 1, wherein the identification mark includes one or more electronically readable indicators identifying each of the first and second connectors.

3. The assembly of claim 1, wherein the connectors electrically connect a first vehicle component in communication with the first connector and a second vehicle component in communication with the second connector when the connectors are completely engaged.

4. The assembly of claim 1, wherein the identification mark and mark section are electronically readable when the connectors are completely engaged and not electronically readable otherwise.

5. The assembly of claim 1, wherein the identification mark includes indicia indicative of adapter engagement or adapter mis-engagement.

6. A high voltage connector assembly comprising:

a first connector including an adapter housing, male pins, and an identification mark;

a second connector including a supplemental mark having a portion of the identification mark, female wells to receive the male pins and ribs extending between the female wells; and an interlock switch arranged to prevent access to at least one of the identification mark and the mark section while in a first position and allow access to at least one of the identification mark and the mark section while in a second position, wherein the supplemental mark aligns with the identification mark to define a complete rendering of the identification mark, and wherein the interlock switch is movable to the second position only when the first and second connector are fully mated to one another.

7. The assembly of claim 6, wherein the identification mark includes one or more electronically readable indicators identifying each of the first and second connectors.

8. The assembly of claim 7, wherein each of the one or more electronically readable indicators are electronically readable by an external device.

9. The assembly of claim 6, wherein the first connector includes a pivotable member arranged to prevent the interlock switch from movement to the second position if the connectors are not fully mated to one another.

10. A high voltage connector assembly comprising:

a connector body having an identification mark;

a pivotable member mounted to the connector body and configured to pivot between a first position allowing disengagement of the connector body from a mating connector and a second position restricting disengagement of the connector body; and an interlock switch arranged to engage the pivotable member and prevent access to the identification mark when the pivotable member is in the first position.

11. The connector assembly of claim 10 wherein the interlock switch is arranged to reveal the identification mark to be electronically readable by an external device when the pivotable member is in the second position.

12. The connector assembly of claim 11 wherein interlock switch is arranged to reveal the identification mark to be electronically readable when the connector body is fully engaged to the mating connector and not electronically readable otherwise.

13. The connector assembly of claim 10 wherein the interlock switch is arranged to prevent access by covering a portion of the identification mark.

14. The connector assembly of claim 10 wherein the mating connector includes a supplemental mark having a portion of the identification mark arranged to define a complete rendering of the identification mark when the when the connector body is fully engaged to the mating connector.

15. The connector assembly of claim 10 wherein the identification mark includes indicia indicative of adapter engagement or adapter mis-engagement.

16. The connector assembly of claim 10 wherein the pivotable member is arranged to prevent the interlock switch from allowing access to the identification mark when the pivotable member is in the first position.

* * * * *